US009901771B1

(12) United States Patent
Silver

(10) Patent No.: US 9,901,771 B1
(45) Date of Patent: Feb. 27, 2018

(54) REMOVABLE COVER FOR AN EXERCISE EQUIPMENT HANDLE

(71) Applicant: Elizabeth Silver, Philadelphia, PA (US)

(72) Inventor: Elizabeth Silver, Philadelphia, PA (US)

( * ) Notice: Subject to any disclaimer, the term of this patent is extended or adjusted under 35 U.S.C. 154(b) by 0 days.

(21) Appl. No.: 15/376,770

(22) Filed: Dec. 13, 2016

(51) Int. Cl.
*E05B 1/00* (2006.01)
*A63B 21/00* (2006.01)
*A63B 71/00* (2006.01)

(52) U.S. Cl.
CPC ..... *A63B 21/4035* (2015.10); *A63B 71/00* (2013.01)

(58) Field of Classification Search
CPC ..... A63B 21/4035
USPC ..... 428/100; 215/11.6
See application file for complete search history.

(56) References Cited

U.S. PATENT DOCUMENTS

2006/0237470 A1* 10/2006 Zanner ..... A47J 45/085 220/752

* cited by examiner

*Primary Examiner* — Brent T O'Hern
(74) *Attorney, Agent, or Firm* — Stuart M. Goldstein

(57) ABSTRACT

A cover for exercise equipment has a cylindrical body which is made of a flexible, waterproof material, infused with antimicrobial, antiodor microban fibers. The body has a plurality of dot projections forming a uniform gripping pattern extending over the entire interior and exterior surfaces of the body. The body is open at one end for facilitating the positioning of the cover over an outwardly extending exercise handle. Another embodiment of the invention consists of a single flat rectangular sheet component which can be positioned around exercise handles and secured by hook and loop attachments or equivalent attachment devices.

6 Claims, 9 Drawing Sheets

REMOVABLE COVER FOR AN EXERCISE EQUIPMENT HANDLE

FIELD OF THE INVENTION

The present invention relates to exercise equipment, and more particularly to removable sanitary covers for exercise equipment.

BACKGROUND OF THE INVENTION

Public and private health clubs and exercise and fitness facilities have recently enjoyed increased popularity. Over sixty-three million Americans utilized some type of health and fitness club in 2014, up 2.3% from 2013. Over the last two years, total health club visits exceeded five billion. These health clubs and exercise and fitness facilities have various pieces of exercise equipment. Equipment such as treadmills, stair-stepper machines, elliptical trainers, weight apparatus, and stationary bicycles, are commonly made available to users, as are different configurations of free weights. These types of exercise equipment have at least one thing in common: they all comprise handles which are grasped by the user during exercising.

Exercise equipment and free weights located in facilities to which the public is invited is utilized by numerous individuals and, as a result, so too are the handles on the equipment being used. This presents an obvious, potential sanitary hazard, since the handles, at the very least, accumulate perspiration from the different individuals using the equipment and, at worse, become contaminated with germs and bacteria which could lead to communicable disease.

Most fitness facilities do not have adequate staff to clean each piece of equipment after every use. Instead, they rely on users to wipe down their machines when finished by offering either spray cleaners or wipes. However, the type of cleaning product a facility offers matters less than how it is actually used; both spray cleaners and wipes can only be effective if used correctly.

However, much too often the equipment is not adequately cleaned or not cleaned at all. In any event, the next user has no assurance that the exercise equipment, and particularly the equipment's handles, are free from contamination.

SUMMARY OF THE INVENTION

It is thus the object of the present invention to provide a safe and sanitary cover for exercise equipment handles.

It is the object of the present invention to provide a cover for exercise equipment handles which acts as an antimicrobial, antiodor barrier due to the infusion of microban fibers into the cover.

It is another object of the present invention to provide a cover for exercise equipment handles which is configured to fit over or extend around the handles.

It is a further object of the present invention to provide a cover for exercise equipment handles which is removable from the handles and which can then be washed and reused.

It is still another object of the present invention to provide a cover for exercise equipment handles which is lightweight and portable.

It is another object of the present invention to provide a cover for exercise equipment handles which comprises dot projections forming a uniform gripping pattern on the exterior surface of the cover to facilitate grasping of the handles.

It is a further object of the present invention to provide a cover for exercise equipment handles which comprises dot projections forming a uniform gripping pattern over the entire interior surface of the cover for maintaining the cover over or around the handles.

These and other objects are accomplished by the present invention, a cover for exercise equipment handles comprising a cylindrical body which is made of a flexible, waterproof material, infused with antimicrobial, antiodor microban fibers. The body has a plurality of dot projections forming a uniform gripping pattern extending over the entire interior and exterior surfaces of the body. The body is open at one end for facilitating the positioning of the cover over an outwardly extending exercise handle. Another embodiment of the invention comprises a single flat rectangular sheet component which can be positioned around exercise handles and secured by hook and loop attachments or equivalent attachment means.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
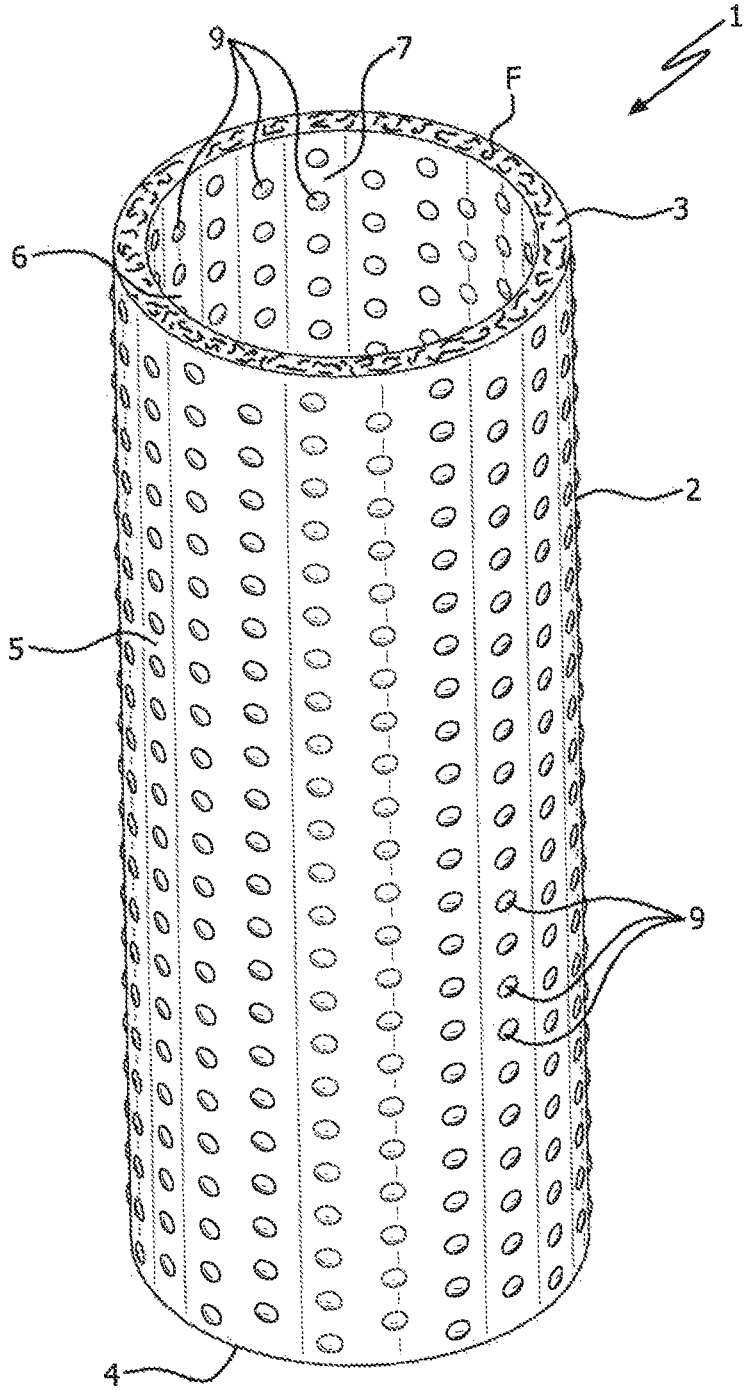
FIG. 1 is a top perspective view of the cover of the present invention.
Figure 2:
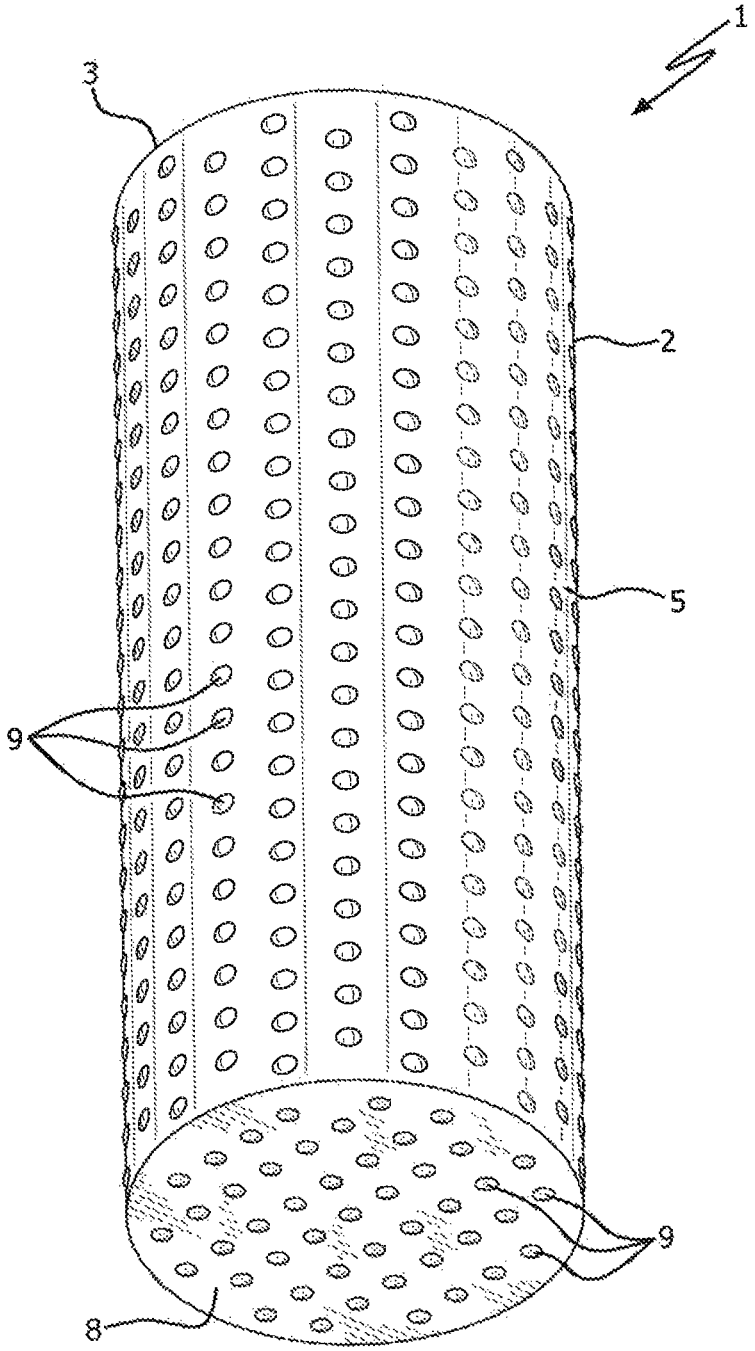
FIG. 2 is a bottom perspective view of the cover of the present invention.
Figure 3:
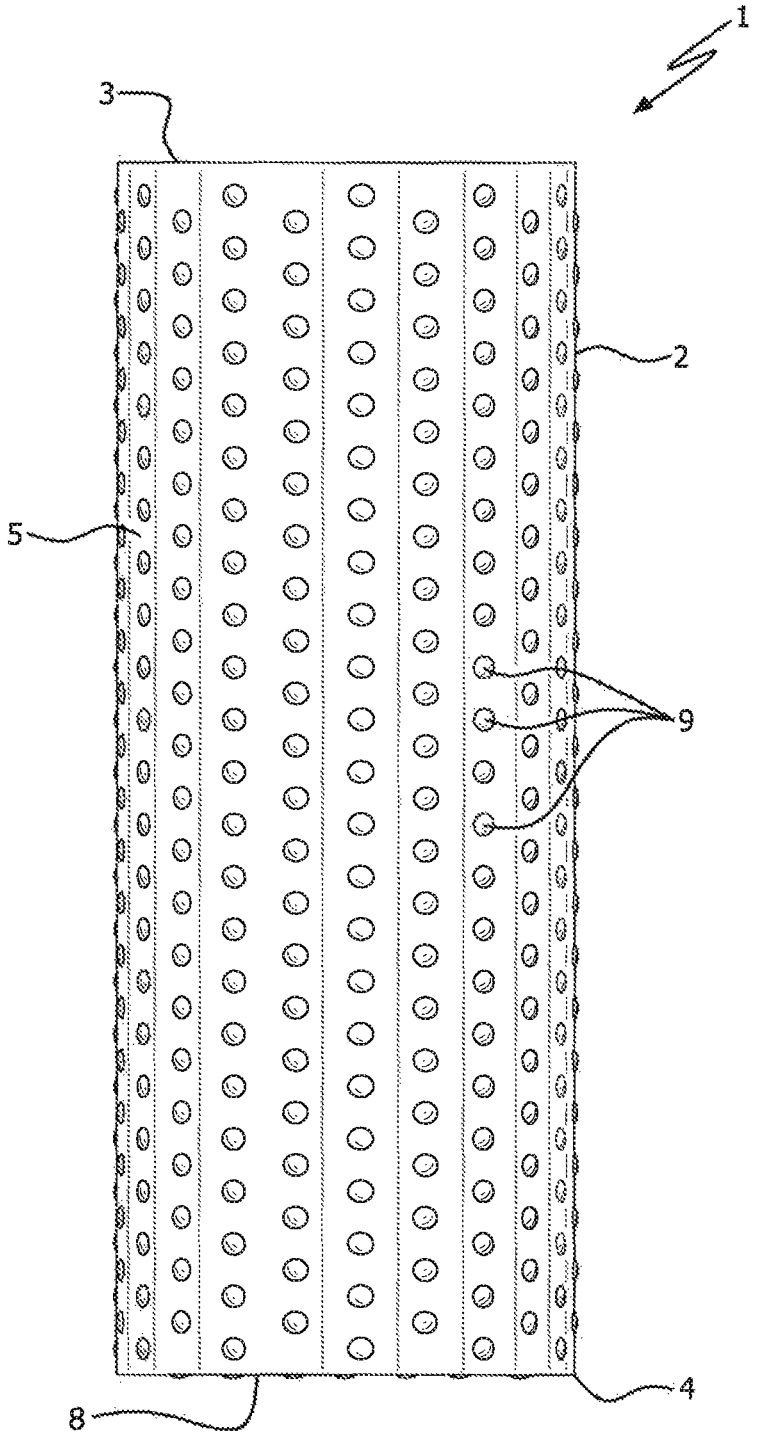
FIG. 3 is an elevation view of the cover of the present invention.
Figure 4:
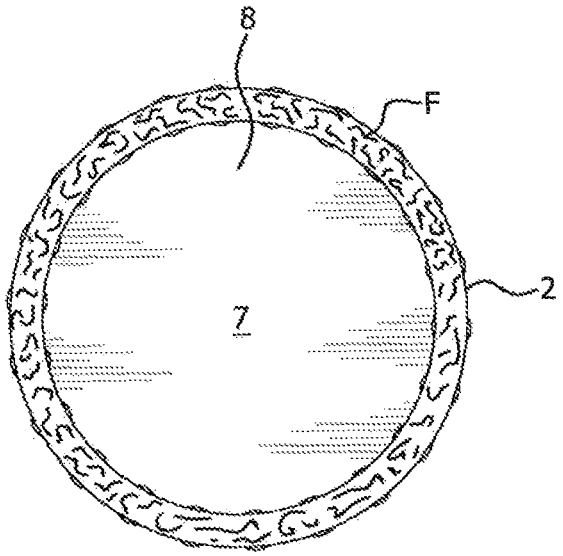
FIG. 4 is a top view of the cover of the present invention.
Figure 5:
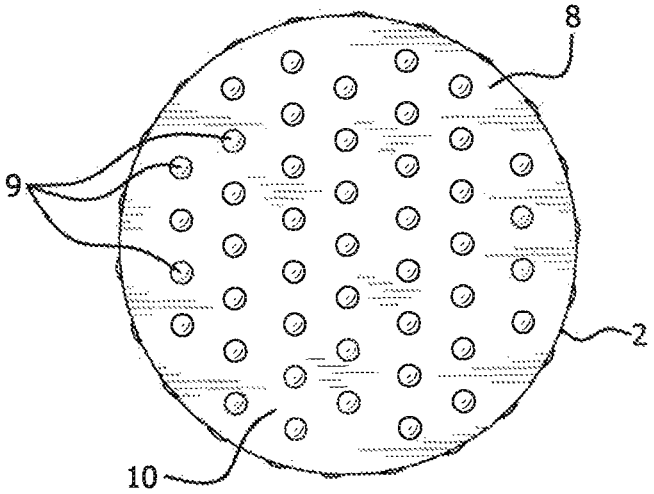
FIG. 5 is a bottom view of the cover of the present invention.
Figure 6:
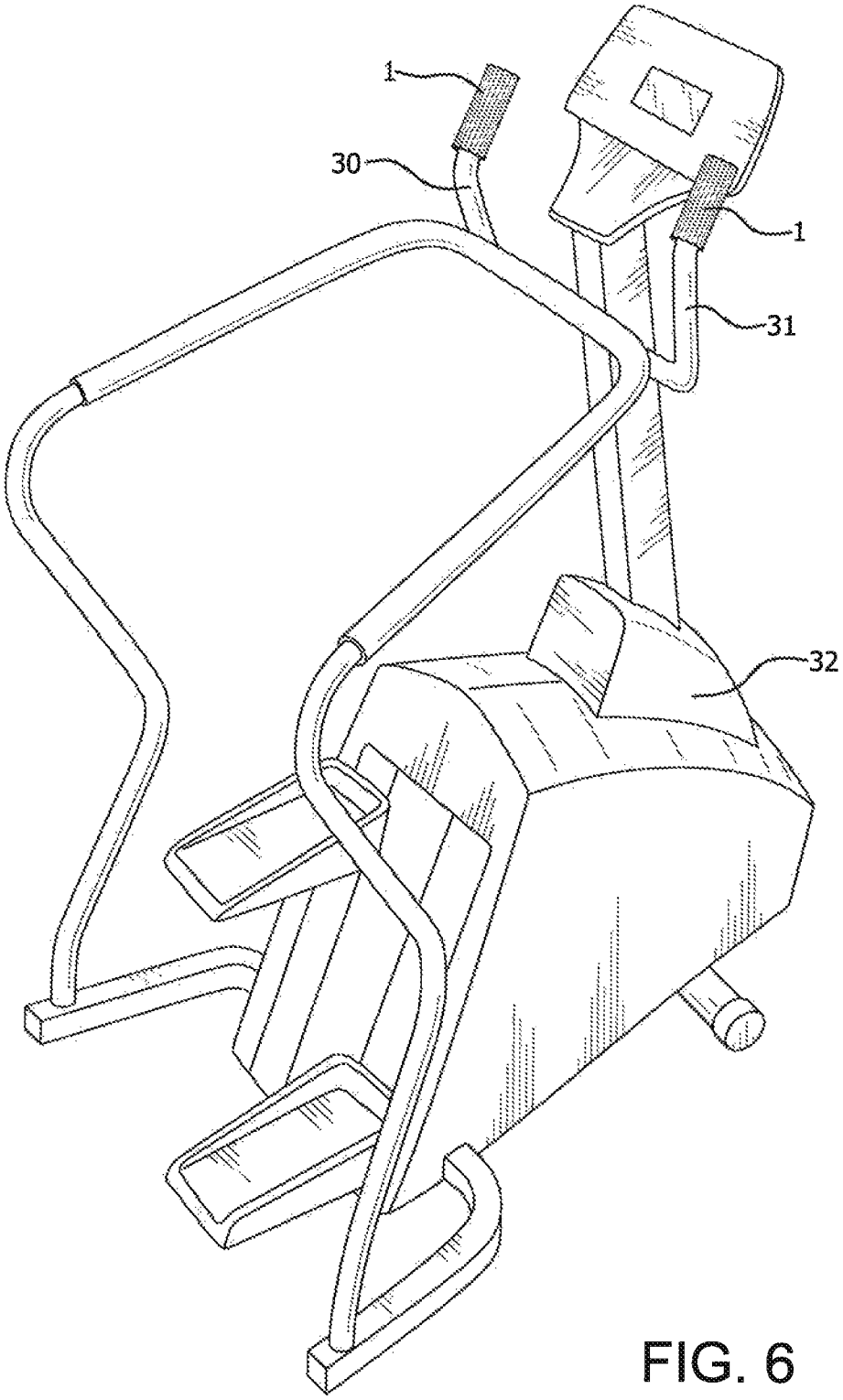
FIG. 6 shows the cover of the present invention positioned on the arm members of exercise equipment.
Figure 7:
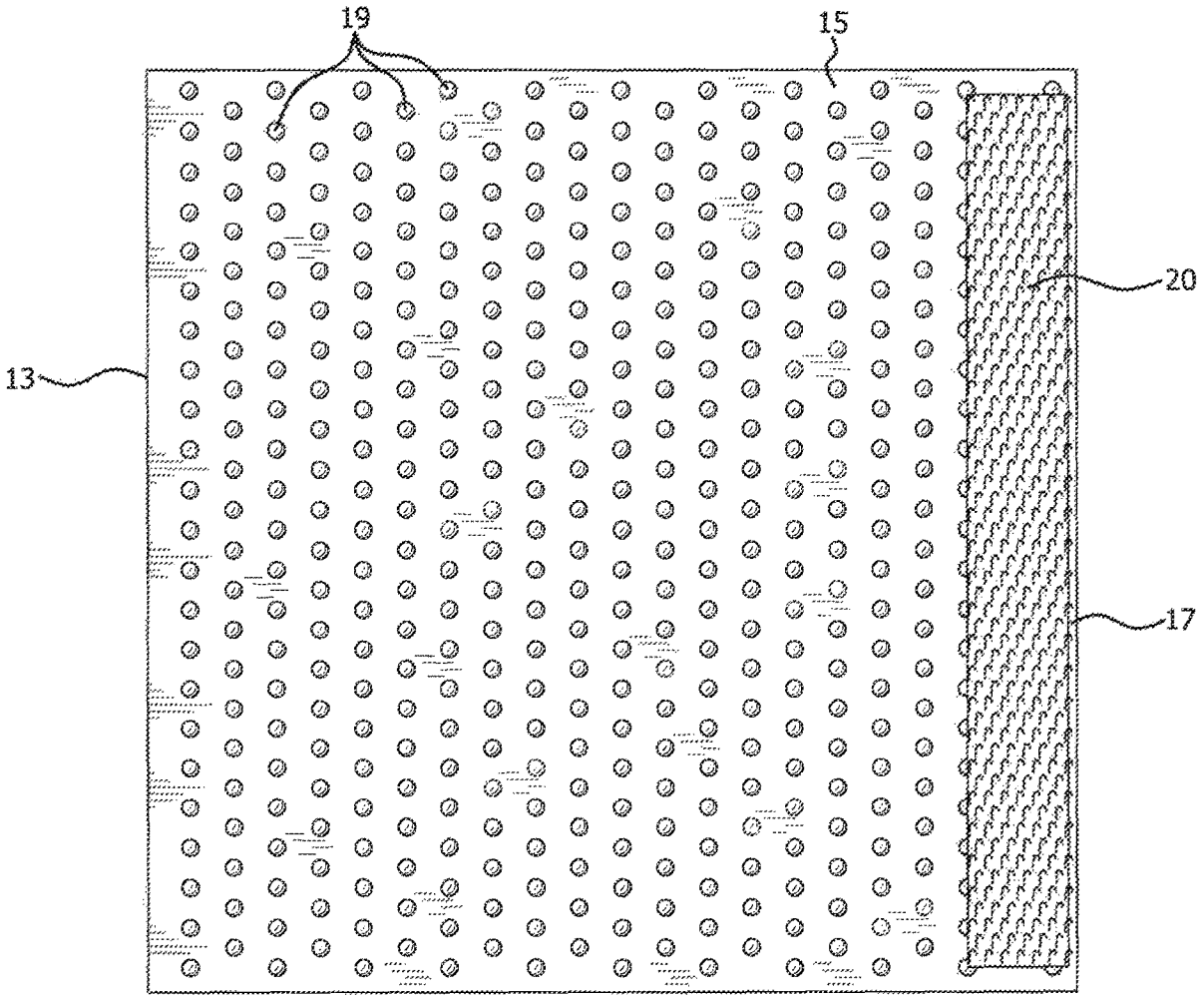
FIG. 7 is a plan view showing the interior surface of an alternate embodiment of the cover of the present invention.
Figure 8:
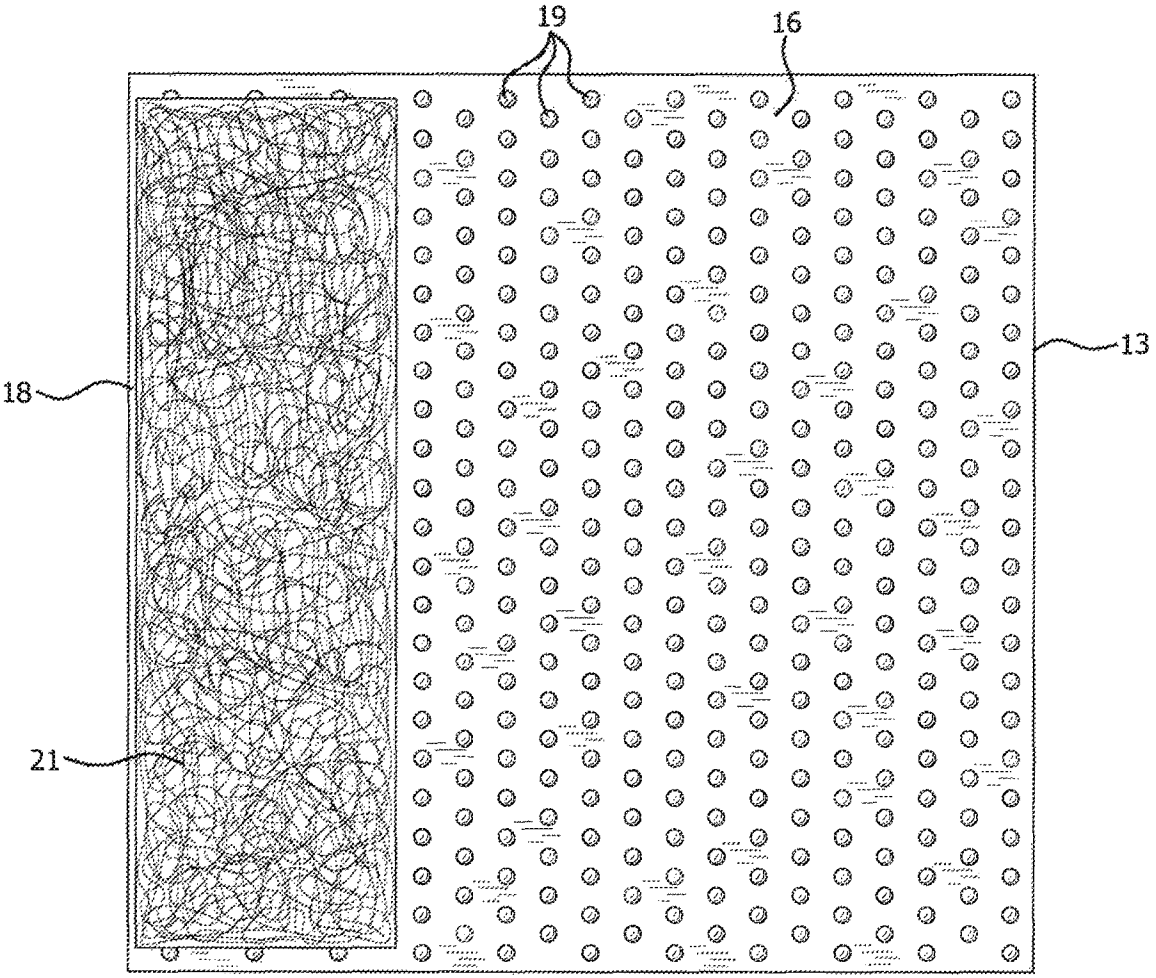
FIG. 8 is a plan view showing the exterior surface of the alternate embodiment of the cover of the present invention.
Figure 9:
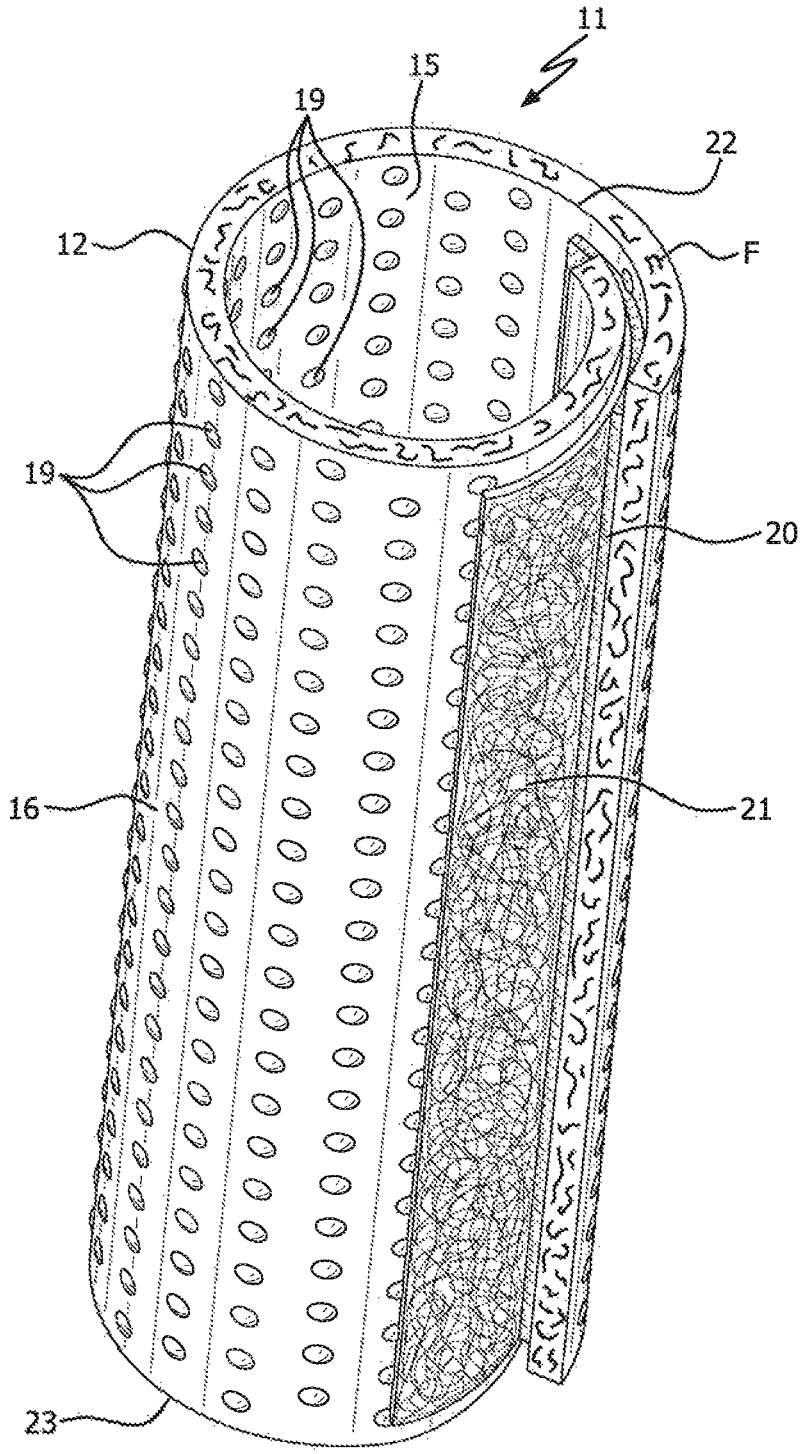
FIG. 9 is a top perspective view of the alternate embodiment of the present invention in its cylindrical form.
Figure 10:
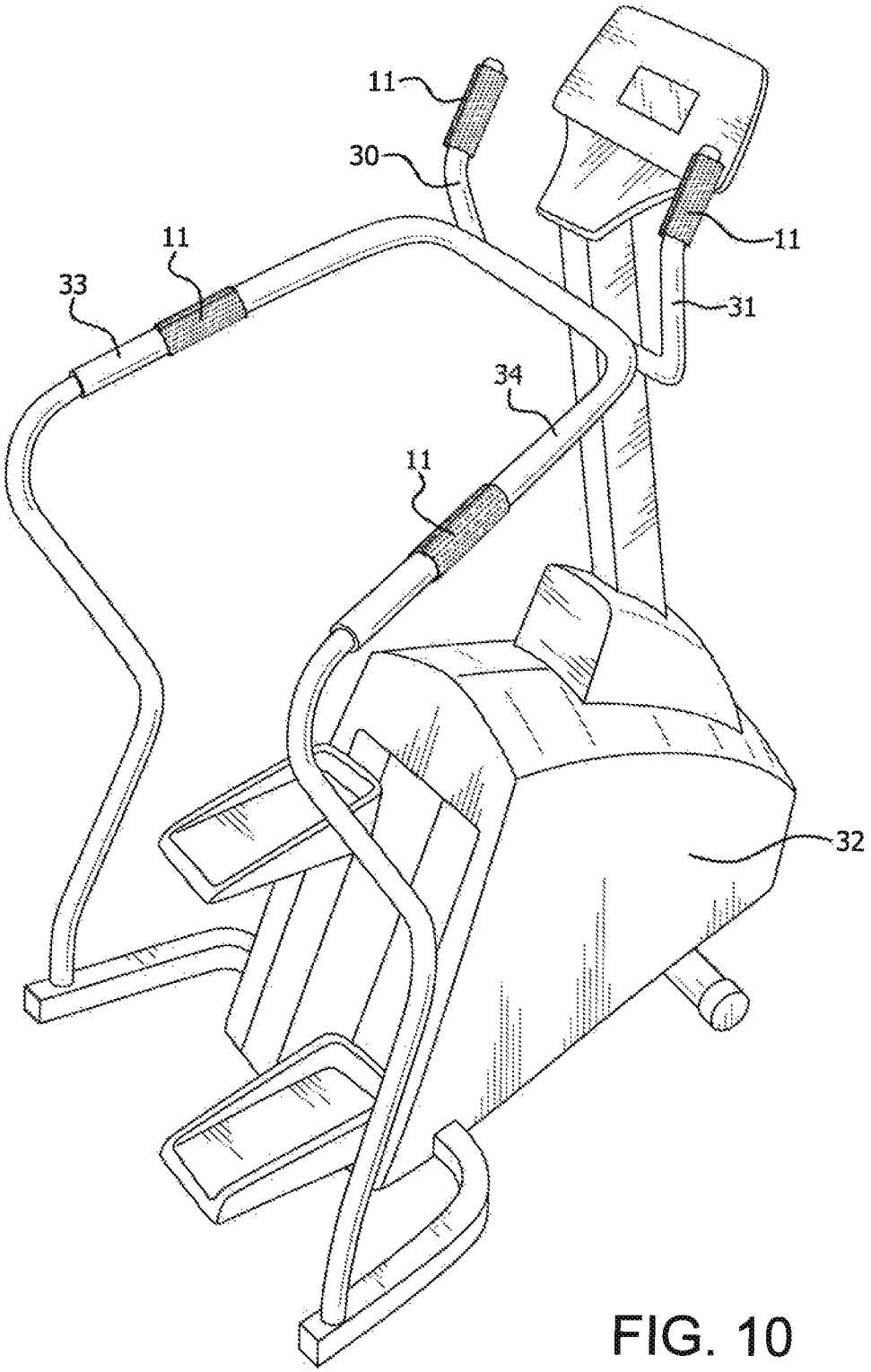
FIG. 10 shows the alternate embodiment of the cover of the present invention positioned on the arm members of exercise equipment.

Cover 1 (FIGS. 1-6) and cover 11 (FIGS. 7-10) of the present invention each comprise cylindrical bodies 2 and 12 made of a flexible, waterproof material such as neoprene, vinyl, terry cloth, or equivalent material. It is also contemplated that the material for the covers will be infused with microban fibers F, in order to provide an antimicrobial and antiodor barrier which prevents germ accumulation and limits odors. Cylindrical body 2 comprises top end 3, bottom end 4, exterior surface 5 and interior surface 6. Top end 3 has end opening 7. Bottom member 8, having an inside surface and outside surface 10, extends over bottom end 4 to enclose the bottom end of body 2. A plurality of dot projections 9 form a uniform gripping pattern over entire exterior surface 5 and interior surface 6. A plurality of dot projections 9 extend over outside surface 10.

Cylindrical body 12 of cover 11 comprises a flat, rectangular shape cover component 13. Cover component 13 has interior surface 15 and exterior surface 16. First connecting means in the form of attachment hooks 20 is located adjacent to lateral edge 17 of cover component 13 and second connecting means in the form of attachment loops 21 is located and secured adjacent to lateral edge 18 of the cover component. Of course, it is contemplated that attachment hooks 20 can be secured to lateral edge 18 and attachment loops 21 can be secured to lateral edge 17. Equivalent connection means, such as buttons, snaps, etc. can be used in lieu of the hook and loop connectors.

A plurality of dot projections 19 forming a uniform gripping pattern extend over the entire exterior surface 15 and interior surface 16 of cover component 13. Attachment hooks 20 and attachment loops 21 are configured to attach lateral edges 17 and 18 to form cylindrical body 12. Cylindrical body 12 has top end 22 and bottom end 23, both of which are open such that the cylindrical body forms an elongated cylindrical tube, open at each end.

In use, cover 1 is positioned over arm members 30 and 31 of exercise equipment 32, with the arm members extending through bottom openings 7 of the cover. Cover 1 is positioned such that patterned dot projections 9 on interior surface 6 contact arm members 30 and 31 and the patterned dot projections on exterior surface 5 are available to be gripped by a user of exercise equipment 32.

In use, cover component 13 of cover 11 is wrapped around arm members 30 and 31 and/or 33 and 34 of exercise equipment 32 and secured by attachment hooks 20 and attachment loops 21. In this wrapped position, arm members 30 and 31 extend through top and bottom ends 22 and 23 of cover 11 and patterned dot projections 19 on interior surface 16 contact the arm members and the patterned dot projections on exterior surface 15 are available to be gripped by a user of exercise equipment 32.

When covers 1 and 11 are in place over arm members 30 and 31, the user can be assured that perspiration, germs, or other possible contaminants which may be on the surfaces of the arm members by prior users will not contact the user's hands. The infused microban fibers F provide an added measure of protection to the user. Covers 1 and 11 will also provide a degree of protection for subsequent users, since the covers are to be removed immediately following use. Patterned dot projections 9 and 19 on the interior surfaces of covers 1 and 11 respectively, ensure that the covers will remain stationary on arm members 30 and 31; and the patterned dot projections on the exterior surfaces of the covers provide the user with additional assistance in gripping the covers by providing traction to the hands of the user with little or no slippage.

After use, covers 1 and 11 are removed from arm members 30 and 31. The covers can be washed and reused.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A removable cover for arm members of exercise equipment, said cover comprising:

a cylindrical body made of a waterproof material, comprising a flat, rectangular shaped cover component, said component having first and second lateral edges and first connecting means located adjacent to the first lateral edge and second connecting means located adjacent to the second lateral edge, the first and second connecting means for attaching the first and second edges together to form the cylindrical body, the formed cylindrical body having at least one end opening and an exterior surface and an interior surface, both the exterior and interior surfaces having a plurality of dot projections forming a uniform gripping pattern, the patterned dot projections extending over the entire exterior and interior surfaces of the body, whereby the cover is to be positioned over arm members of exercise equipment, with the arm members extending through at least one end opening such that the patterned dot projections on the interior surface contact the arm members and the patterned dot projections on the exterior surface are gripped by a user of the exercise equipment.

2. The removable cover as in claim 1 wherein the cylindrical body has a top end, a bottom end, and a bottom member extending over and enclosing the bottom end, the top end comprising at least one opening.

3. The removable cover as in claim 2 wherein the bottom end has an inside surface and an outside surface, the outside surface having a plurality of projections forming a uniform gripping pattern identical to the gripping pattern extending over the exterior surface of the body.

4. The removable cover as in claim 1 wherein the first connecting means comprises attachment hooks and the second connecting means comprises attachment loops.

5. The removable cover as in claim 4 wherein the cylindrical body has a top end and a bottom end, both of which are open.

6. The removable cover as in claim 1 wherein the material comprises infused microban fibers.

* * * * *